US009844279B2

(12) United States Patent
Cinici et al.

(10) Patent No.: US 9,844,279 B2
(45) Date of Patent: Dec. 19, 2017

(54) HOUSEHOLD APPLIANCE, IN PARTICULAR BEVERAGE BOTTLE STORAGE CABINET WITH SPECIFIC BOTTLE ILLUMINATION

(71) Applicant: BSH HAUSGERAETE GMBH, Munich (DE)

(72) Inventors: Bilal Cinici, Tekirdag (TR); Lars Dinter, Munich (DE); Mustafa Ertik, Tekirdag (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 118 days.

(21) Appl. No.: 14/974,097

(22) Filed: Dec. 18, 2015

(65) Prior Publication Data

US 2016/0174733 A1 Jun. 23, 2016

(30) Foreign Application Priority Data

Dec. 18, 2014 (TR) ..... 2014 15403

(51) Int. Cl.

| | |
|---|---|
| ***A47F 3/00*** | (2006.01) |
| ***A47F 7/28*** | (2006.01) |
| ***A47B 73/00*** | (2006.01) |
| ***A47F 3/04*** | (2006.01) |
| ***F21V 33/00*** | (2006.01) |
| *F21W 131/305* | (2006.01) |
| *F21V 21/04* | (2006.01) |
| *F21W 131/405* | (2006.01) |

(52) U.S. Cl.

CPC ..... *A47F 3/001* (2013.01); *A47B 73/00* (2013.01); *A47F 3/0434* (2013.01); *A47F 7/28* (2013.01); *F21V 33/0044* (2013.01); *F21V 21/04* (2013.01); *F21W 2131/305* (2013.01); *F21W 2131/405* (2013.01)

(58) Field of Classification Search

CPC . A47F 3/001; A47F 3/04; A47F 11/10; A47B 73/00; F21W 2131/305; F21W 2131/405

USPC ..... 362/125

See application file for complete search history.

(56) References Cited

U.S. PATENT DOCUMENTS

| | | | | |
|---|---|---|---|---|
| 5,508,898 A * | 4/1996 | McGovern | A47F 11/10 312/223.5 |
| 6,827,463 B2 * | 12/2004 | Chuang | A47F 3/0447 362/125 |
| 7,588,342 B2 * | 9/2009 | Buelow, II | A47F 3/001 362/125 |

(Continued)

*Primary Examiner* — Robert May

(74) *Attorney, Agent, or Firm* — Laurence A. Greenberg; Werner H. Stemer; Ralph E. Locher

(57) ABSTRACT

A household appliance, in particular a beverage bottle storage cabinet, has a beverage bottle receiving space, which is delimited by an upper wall. An illuminating device illuminates the beverage bottle receiving space. The upper wall has at least one light transmission opening through which light of a light module of the illuminating device can be radiated into the beverage bottle receiving space. A distance adapter adjoins the light transmission opening. The distance adapter spaces the light module from an underside of the upper wall that delimits the beverage bottle receiving space outside the beverage bottle receiving space. The distance adapter allows light from the light module to be directed to the light transmission opening.

14 Claims, 3 Drawing Sheets

(56) References Cited

U.S. PATENT DOCUMENTS

| | | | | |
|---|---|---|---|---|
| 2010/0180615 | A1* | 7/2010 | Linder | A47F 3/0434 62/248 |
| 2014/0254136 | A1* | 9/2014 | Oraw | F21V 19/004 362/92 |

* cited by examiner

HOUSEHOLD APPLIANCE, IN PARTICULAR BEVERAGE BOTTLE STORAGE CABINET WITH SPECIFIC BOTTLE ILLUMINATION

CROSS-REFERENCE TO RELATED APPLICATION

This application claims the priority, under 35 U.S.C. §119, of Turkish patent application TR 2014/15403, filed Dec. 18, 2014; the prior application is herewith incorporated by reference in its entirety.

BACKGROUND OF THE INVENTION

Field of the Invention

The invention relates to a household appliance and, in particular, to a beverage bottle storage cabinet, with a beverage bottle receiving space delimited by an upper wall, and with an illuminating device for illuminating the beverage bottle receiving space.

Household appliances for receiving beverage bottles are known. In this context so-called wine bottle storage cabinets are known, in which the appropriate bottles can be stored. With these household appliances it is usually provided that a door for closing the beverage bottle receiving space is transparent so that the beverage bottles stored therein are at least partially visible even when the door is closed. Usually also an illumination can be activated permanently or intermittently so that the beverage bottles stored therein can be illuminated and seen from outside when the door is closed.

Besides, also household appliances in the form of domestic cooling appliances are known, which besides a cooling space also have a separate compartment and thus a beverage bottle receiving space, in which beverage bottles can be stored and cooled. Moreover, with such domestic cooling appliances it is in particular provided that the entire receiving space additionally has a second partial volume, in which other foodstuffs can be stored.

However, in the known embodiments the illumination of the beverage bottles is limited in that these can be illuminated only partially and thus insufficiently homogenously, i.e. visibility is restricted.

SUMMARY OF THE INVENTION

It is accordingly an object of the invention to provide a domestic appliance such as a beverage bottle storage cabinet with specific bottle illumination which overcomes the above-mentioned and other disadvantages of the heretofore-known devices and methods of this general type and which provides for an improved illumination of beverage bottles stored therein.

With the foregoing and other objects in view there is provided, in accordance with the invention, a household appliance, comprising:

- a body containing a beverage bottle receiving space;
- an upper wall delimiting said beverage bottle receiving space;
- an illuminating device for illuminating said beverage bottle receiving space, said illuminating device having a light module;
- said upper wall being formed with at least one light transmission opening configured to enable light of said light module of said illuminating device to be radiated into said beverage bottle receiving space;

- a distance adapter adjoining said light transmission opening, said distance adapter carrying said light module outside said beverage bottle receiving space and spacing said light module from an underside of said upper wall delimiting the beverage bottle receiving space, said distance adapter enabling light from said light module to be directed to said light transmission opening.

The household appliance according to the invention is in particular formed as a beverage bottle storage cabinet. The household appliance comprises a beverage bottle receiving space that is delimited by an upper wall. Besides, the household appliance also has an illuminating device for illuminating the beverage bottle receiving space. An primarily important concept of the invention is to be seen in that the upper wall has at least one light transmission opening through which light of a light module of the illuminating device can be irradiated into the beverage bottle receiving space. Adjacent to the light transmission opening there is a distance adapter, by means of which the further light module arranged thereon is spaced from the wall outside the beverage bottle receiving space and by means of which light from the light module can be directed to the light transmission opening and by means of which beverage bottles in the in the beverage bottle receiving space are illuminated. By means of such an embodiment an improved targeted illumination of beverage bottles arranged in the beverage receiving space is achieved. Thus, the illuminating device is improved quite specifically for the illumination of beverage bottles. By means of the arrangement of the light module outside this beverage bottle receiving space and in such a way that it no longer extends into this receiving space the available space is not reduced and the insertion and removal of beverage bottles is made easier. A bumping against the light module is as it were prevented. Besides by means of this specific positioning of the light module light distribution and light irradiation into the beverage bottle receiving space and to the beverage bottles are more homogenous so that the beverage bottles are illuminated more evenly and homogenously even if the beverage bottle receiving space is filled up to quite an extent, i.e. with a plurality of bottles. Besides by means of this positioning of the light module outside the beverage bottle receiving space and in addition by means of the distance adapter which is spaced from the upper wall a blinding of a person looking into the beverage bottle receiving space is prevented.

It is preferably provided that an inner side of the distance adapter opens out from the light module towards the light transmission opening like a funnel. By means of this embodiment light distribution and light irradiation into the receiving space are again enhanced, since more homogenous light irradiation is achieved and by means of this embodiment of the distance adapter a widening light cone is irradiated into the beverage bottle receiving space or generated.

It is preferably provided that the distance adapter is formed as a separate component, which is fastened to this upper wall. In this context, for example an adhesive connection or a welded connection can be envisaged. It is also possible that the distance adapter is screwed to this upper wall. Other connections are possible as well.

It is preferably provided that the distance adapter is made of plastic. This embodiment can be made in one piece, for example as an injection moulded component. Besides, by means of this embodiment the distance adapter is highly weight-minimized.

It is preferably provided that in its bottom, which faces away from the beverage bottle receiving space, the distance adapter has a continuous hole, which is delimited by a circumferential abutment flange on which the light module is arranged. For one thing, by means of this embodiment an arrangement requiring minimum space is achieved; for another, a mechanically stable fastening of the light module to the distance adapter is enabled.

It is preferably provided that a plane featuring the abutment flange is not parallel to a plane of a front flange of the distance adapter facing the wall. It is particularly provided that these two planes are arranged at an angle of between 30° and 70°, in particular of between 30° and 50°, to each other.

In a particularly advantageous manner a positioning of the light module can be achieved which can emit light diagonally towards the front and downwards into the beverage bottle receiving space. Thus, on the one hand a blinding of a user who looks at the beverage bottles is prevented; on the other hand, however, a very bright and evenly illuminated beverage bottle receiving space can be obtained.

It is preferably provided that the plane of the front flange is a horizontal plane and the plane of the abutment flange, viewed in a depth direction of the household appliance, joins a rear edge of the wall. Thus, a very even positioning perpendicular to a horizontal viewing direction of an observer, which is oriented in a depth direction of the household appliance, is achieved since thus a line of intersection, as it were, between the two planes runs in a straight line in a width direction of the household appliance, which provides for a particularly even and bright as well as low-glare illumination when the beverage bottles are viewed from the front, i.e. when an observer looks into the beverage bottle receiving space.

It is preferably provided that the light module is arranged such that a main radiation direction of the light emitted by the light module is perpendicular to the plane featuring the abutment flange. This further contributes to the desired homogenous and extensively even illumination of the beverage bottle receiving space.

It can be provided that the light module is arranged at the abutment flange via latching. To this end, the light module in particular has a housing, to which a plurality of latching elements are formed in one piece, which in a mounted state abut on an outer side of the abutment flange facing away from the beverage bottle receiving space and thus, viewed from the beverage bottle receiving space, engage behind this abutment flange. By means of this embodiment a particularly mechanically stable connection with the abutment flange can be created. Additionally and in particular, by means of this embodiment of the housing of the light module an abutting of the light module on the abutment flange of the distance adapter is achieved on both sides so that here as well a clamping fit of a kind is achieved, as it were.

It is preferably provided that an inner side of the distance adapter is stepped. Thus, specific and individualized light irradiation into the beverage bottle receiving space can be effected.

In this context it can be provided that these steps are formed completely circumferential around a longitudinal axis of the distance adapter and thus the homogeneity of the optical effect of these steps is increased.

It is preferably provided that in an alternative embodiment an inner side of the distance adapter is stepless.

In a preferred embodiment it is provided that the upper wall is a shelf which separates the beverage bottle receiving space from a further receiving space for food which viewed in a vertical direction of the household appliance is formed on top of it.

Further features of the invention are apparent from the claims, the figures and the description of the figures. The features and features combinations previously mentioned in the description and the features and feature combinations mentioned below in the description of the figures and/or shown in the figures alone are usable not only in the respectively specified combination, but also in other combinations or else alone, without leaving the scope of the invention. Thus, also embodiments are to be regarded as comprised and disclosed by the invention, which are not explicitly shown and explained in the figures, but which derive and producible from the illustrated explanations by separated feature combinations. Also, embodiments and feature combinations are to be regarded as disclosed which thus do not exhibit all features of an originally formulated independent claim.

Other features which are considered as characteristic for the invention are set forth in the appended claims.

Although the invention is illustrated and described herein as embodied in a household appliance, in particular beverage bottle storage cabinet with specific bottle illumination, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

In the figures identical or functionally equivalent elements are identified with the same reference numerals throughout.

DETAILED DESCRIPTION OF THE INVENTION

Figure 1:
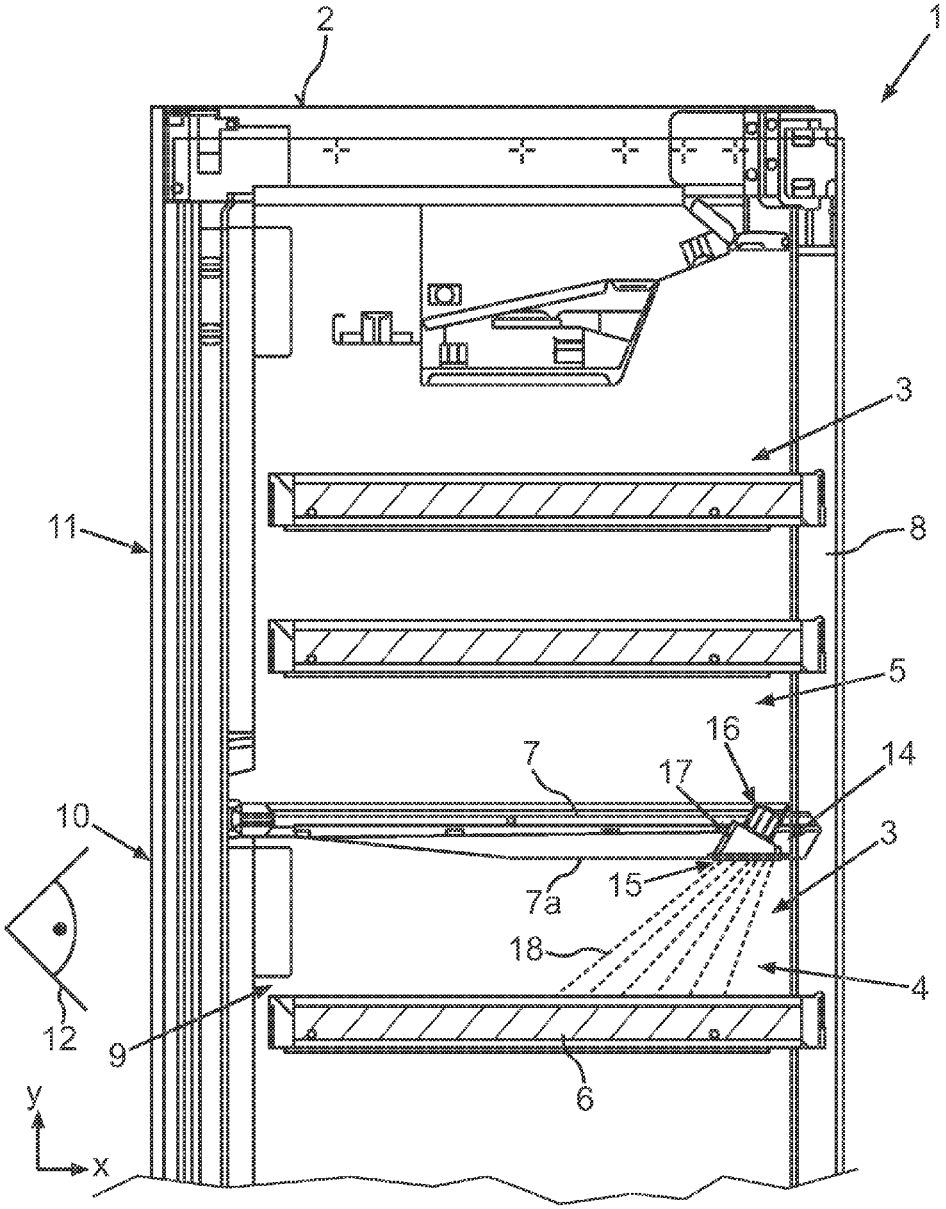
FIG. 1 is a vertical section taken through an embodiment of a household appliance according to the invention.

Referring now to the figures of the drawing in detail and first, particularly, to FIG. 1 thereof, there is shown a household appliance 1, which may be a domestic cooling appliance for storing foodstuffs. However, the household appliance 1 can also be formed as a beverage bottle storage cabinet, for example a wine bottle storage cabinet, which is configured to only store beverage bottles.

In the exemplary embodiment shown in FIG. 1, the household appliance 1 is configured to store further foodstuffs in addition to the storage of beverage bottles. The household appliance 1 comprises a body or corpus 2, which is a housing. In the body 2 a whole interior 3 is formed which is delimited by walls and in which foodstuffs in the form of beverages and food can be stored. In this context the household appliance 1 comprises as a partial volume of the whole interior 3 a beverage bottle receiving space 4, which is specifically and exclusively configured to store beverage bottles. In this embodiment it is provided that in a vertical direction of the household appliance 1 above the beverage bottle receiving space 4 a further partial volume 5 is formed separate therefrom, in which for example food can be stored.

The beverage bottle receiving space 4 is delimited downwards by a bottom 6 and upwards by an upper wall 7. The upper wall 7 can be a fixed wall which cannot be removed; however, it can also be a removable shelf. Preferably, the upper wall 7 is a fixed wall which thus completely separates the beverage bottle receiving space 4 from the further partial volume 5 formed on top of it. To the rear, the entire receiving space 4 is delimited by a rear wall 8. At the front a charging aperture 9 of the beverage bottle receiving space 4 is formed, wherein this charging aperture 9 is closable by a door 10, which in the embodiment illustrated is shown in the closed state. In this context it is provided that the remaining partial volume 5 can also be closed by a front door 11, which can be operated separately from and independently of the door 10.

Preferably, the door 10 is transparent so that to an eye 12 of an observer outside the beverage bottle receiving space 4 visibility of the beverage bottles 13 (FIG. 2) stored therein is enabled through the closed door 10.

Besides, the household appliance 1 further comprises an illuminating device 14, which is configured and arranged to illuminate the beverage bottle receiving space 4. To this end it is provided that the upper wall 7 has at least one light transmission opening 15, through which light of a light module 16 of the illuminating device 14 can be irradiated into the beverage bottle receiving space 4. Adjacent to the light transmission opening 15 a distance adapter 17 is arranged which is formed as a separate component. The light module 16 is arranged on this distance adapter 17 such that it is spaced from an underside 7*a* of the wall 7 with an upward offset and thus faces away from the beverage bottle receiving space 4. Moreover, by means of this distance adapter 17 the light emitted by the light module 16 can be directed to the light transmission opening 15 and from there into the beverage bottle receiving space 4 in a targeted manner. As can be seen from the illustration of FIG. 1, the upper wall 7 is formed such that the light module 16 and also the distance adapter 17 are arranged to fit entirely within this wall 7 and thus the wall 7 as regards its thickness which extends in a vertical direction (y direction) of the household appliance 1 does not extend beyond these thickness dimensions. Thus, the light module 16 and the distance adapter 17 are arranged and embedded entirely within this wall 7.

As can be seen, rays of light 18 of the light module 16 are emitted diagonally downwards and rearwards into the beverage bottle receiving space 4 and thus so as to face away from the door 10.

Figure 2:
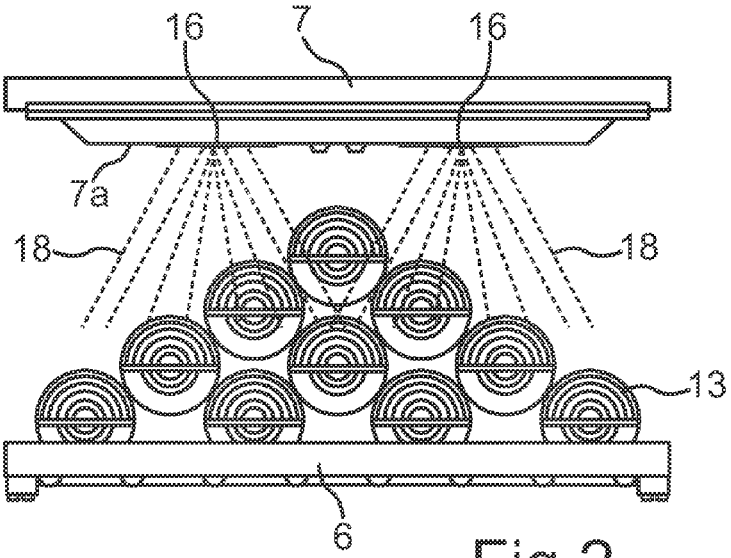
FIG. 2 is a front view of a partial area of the household appliance according to FIG. 1.

In FIG. 2 a front view and thus a view in the x-direction is shown and thus a view of the stored beverage bottles 13 perceived by the eye 12 as shown in FIG. 1. It can be seen that by means of the two vicinal and separate light modules 16 in the upper wall 7 a particularly homogenous illumination of the beverage bottle receiving space 4 and thus of the stored beverage bottles can be achieved. This is especially so if the bottles are stacked on top of one another as shown in FIG. 2.

By way of the recessed placement of the light module 16 also a blinding of the eye 12 is prevented and, also, when the beverage bottle receiving space 4 is inspected in accordance with the position of the eye 12 the light module 16 cannot be directly seen.

As it is shown in FIG. 2 the light module 16 is inclined to a horizontal plane, especially the wall 7. Therefore the light of said light module 16 is emitted diagonally towards the front and downwards into the beverage bottle receiving space 4. The main radiation direction of the light emitted by the light module 16 is inclined, especially at an angle between 30° and 70°, to said horizontal plane.

Figure 3:
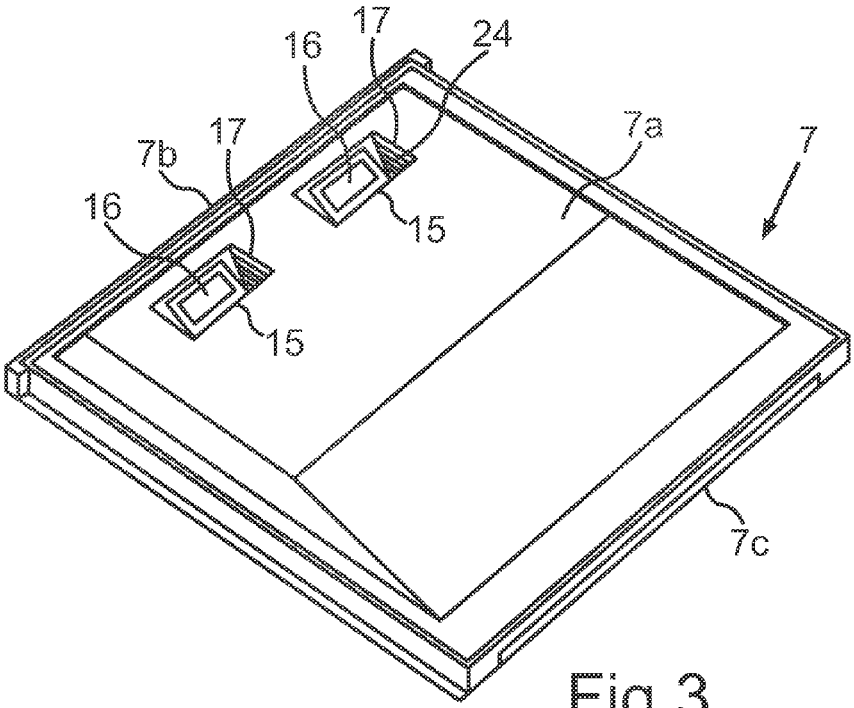
FIG. 3 is a perspective view of the upper wall of the household appliance according to FIG. 1 which delimits a beverage bottle receiving space.

In FIG. 3 the upper wall 7 is shown in a perspective view. The view is directed to the underside 7*a* so that the light modules 16 and the distance adapters 17 can be seen. As is additionally shown, viewed in a depth direction and thus in the x direction of the household appliance 1, these two light modules 16 are formed in a front third of the extension of this wall 7 in this direction. They are thus in vicinal arrangement and closer to a front edge 7*b*, which is closer to the door 10, than a rear edge 7*c* of this wall 7 which is closer to the rear wall 8.

Figure 4:
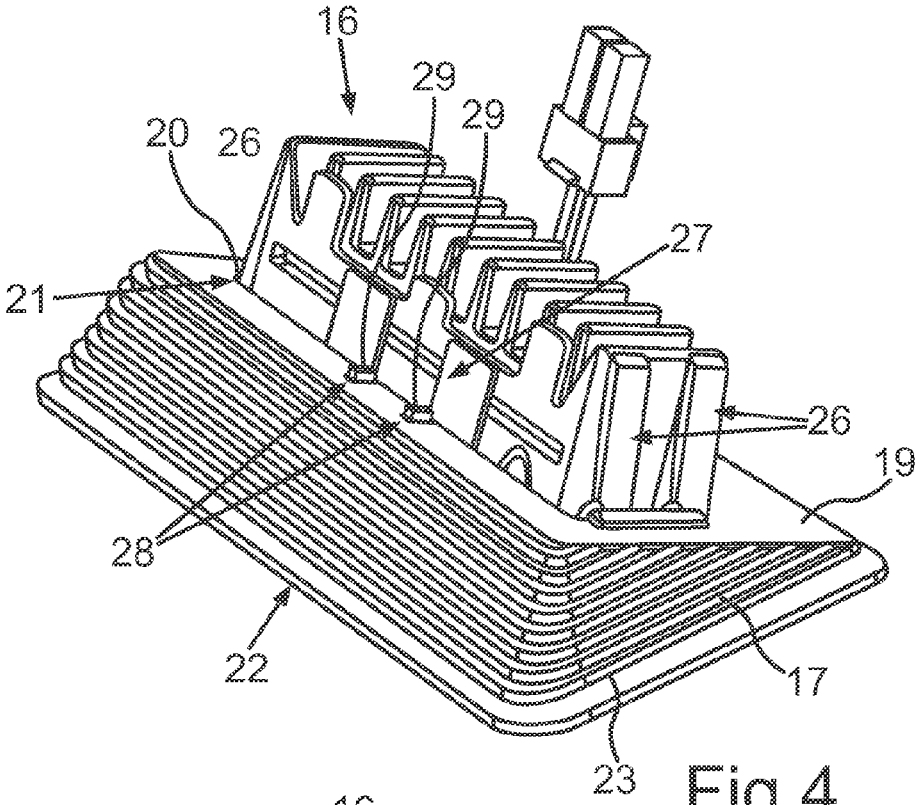
FIG. 4 is a perspective view of a module with a distance adapter and a light module as it is installed in the household appliance according to FIG. 1.

In FIG. 4 in a perspective view an embodiment of a module comprising the light module 16 arranged on the distance adapter 17 is shown. Here the distance adapter 17 is asymmetrical, which means that a plane E1 (FIG. 5) is not parallel to a plane E2 but arranged at an angle $\alpha$ which is between 30° and 70°, preferably between 30° and 50°. The plane E1 is oriented such that it holds the abutment flange 19 (FIG. 4); in other words the abutment flange 19 extends in this plane E1. The abutment flange 19 defines a continuous opening or hole 20 of a bottom 21 of the distance adapter 17. In a mounted state the light module 16 extends through this hole 20. The bottom 21 faces away from the beverage bottle receiving space 4 and a front side 22 of the distance adapter 17 faces the beverage bottle receiving space 4 and is therefore nearer to the beverage bottle receiving space 4. This front side 22 comprises a front flange 23 of the distance adapter 17, wherein said front flange 23 extends in the plane E2. Besides, the distance adapter 17 is formed to be conical or funnel-like with at least one inner side 24. This means that it opens out from its side which faces the light module 16 and thus from the bottom 21 towards the front side 22.

The distance adapter 17 is made of plastic and formed in one piece. In one embodiment it is envisaged that the inner side 24 (FIG. 3) can be stepped. This means in particular that steps are formed at least partially circumferential around a longitudinal axis A of the distance adapter 17.

However, it is also possible to form the inner side 24 is stepless and thus with flat walls.

Figure 5:
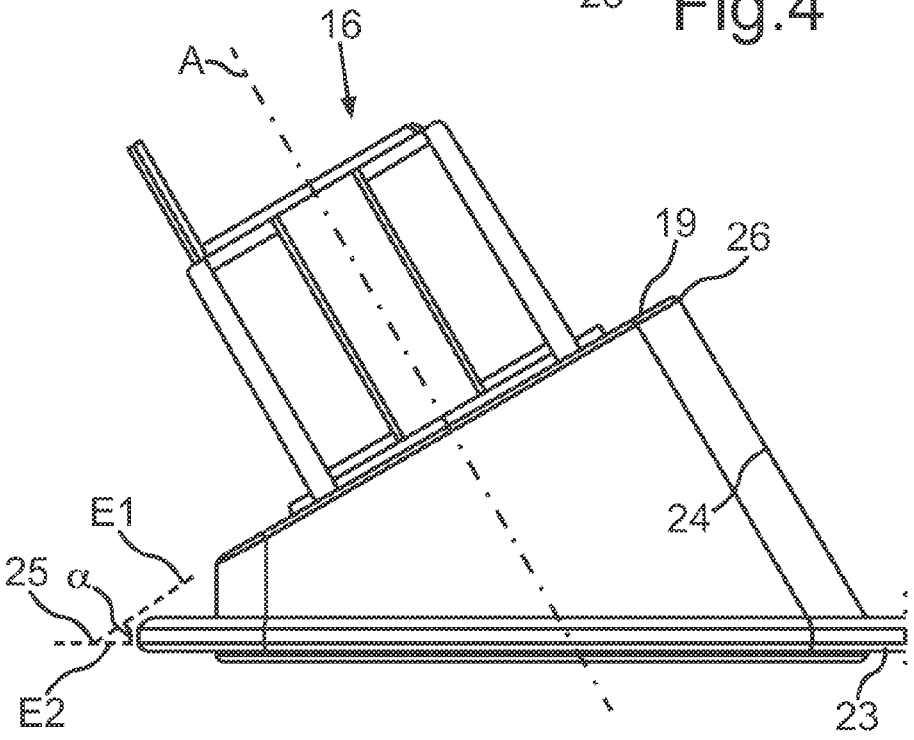
FIG. 5 is a side view of the device of FIG. 4.

Advantageously it can be gathered from FIG. 3 to FIG. 5 that the planes E1 and E2 intersect in a straight line 25 which is closer to the front edge 7*b* than the free ends 26 and 27 of the planes E1 and E2 opposite the straight line 25. This means that the planes E1, E2 are oriented and arranged such that the wedge-shaped volume space (cf. side view of FIG. 5) formed by the arrangement of the planes E1 and E2 is oriented as it were diagonally backwards in the direction of the rear wall 8, as can also clearly be seen in FIG. 1.

As can further be gathered from FIG. 4, the light module 16 comprises latching elements 28 formed in one piece to a housing 29 of the light module 16. These latching elements 28 abut on an upper side or outer side of the abutment flange 19 so that the light module 16 is latched or snapped onto the distance adapter 17. The housing 29 further comprises a front flange (not recognizable in FIG. 4) which is preferably circumferential and abuts on the abutment flange 19 on the inner side. Thus the abutment flange 19 is in contact with the housing 29 on both sides, on the one hand via said front flange of the housing 29 and on the other via the latching elements 28.

To prevent incorrect mounting of the light module on the distance adapter 17, an assembly coding is provided. For this purpose, in the abutment flange 19 recesses 30 are formed into which engaging elements 31 which are formed on the housing 29 engage or through which they extend.

The following is a summary list of reference numerals and the corresponding structure used in the above description of the invention:

1 household appliance
2 corpus, body
3 interior
4 beverage bottle receiving space
5 partial volume
6 bottom
7 wall
7*a* underside
7*b* edge
7*c* wall
8 rear wall
9 charging aperture
10, 11 door
12 eye
13 beverage bottles
14 illuminating device
15 light transmission opening
16 light module
17 distance adapter
18 rays of light
19 abutment flange
20 hole
21 bottom
22 front side
23 front flange
24 inner side
25 straight line
26, 27 end
28 latching elements
29 housing
30 recesses
31 engaging elements
E1 plane
E2 plane

The invention claimed is:

1. A household appliance, comprising:

a body containing a beverage bottle receiving space;

an upper wall delimiting said beverage bottle receiving space;

an illuminating device for illuminating said beverage bottle receiving space, said illuminating device having a light module;

said upper wall being formed with at least one light transmission opening configured to enable light of said light module of said illuminating device to be radiated into said beverage bottle receiving space;

a distance adapter adjoining said light transmission opening, said distance adapter carrying said light module outside said beverage bottle receiving space and spacing said light module from an underside of said upper wall delimiting the beverage bottle receiving space, said distance adapter enabling light from said light module to be directed to said light transmission opening;

said distance adapter having a bottom facing away from said beverage bottle receiving space, said bottom being formed with a continuous hole that is delimited by a circumferential abutment flange on which said light module is disposed; and said distance adapter being formed with said abutment flange and a front flange facing toward said upper wall, and said abutment flange defining a plane that is inclined relative to a plane of said front flange.

2. The household appliance according to claim 1, wherein an inner side of said distance adapter opens out from said light module towards said light transmission opening in the form of a funnel.

3. The household appliance according to claim 1, wherein said distance adapter is a separate component fastened to said upper wall.

4. The household appliance according to claim 1, wherein said distance adapter is made of plastic.

5. The household appliance according to claim 1, wherein said light module is positioned to emit light diagonally forward towards a front and downwards into said beverage bottle receiving space.

6. The household appliance according to claim 1, wherein said plane defined by said abutment flange is inclined at an angle of between 30° and 70° relative to the plane of said front flange.

7. The household appliance according to claim 1, wherein said light module is arranged such that a main radiation direction of light emitted by said light module is perpendicular to said plane of said abutment flange.

8. The household appliance according to claim 1, wherein said light module is mounted to said abutment flange by way of latches.

9. The household appliance according to claim 1, wherein said distance adapter has a stepped inner side.

10. The household appliance according to claim 1, wherein said upper wall is a shelf that separates said beverage bottle receiving space from a further receiving space formed above said beverage bottle receiving space.

11. The household appliance according to claim 1, wherein said light module and said distance adapter are arranged to fit entirely within said upper wall.

12. The household appliance according to claim 1, configured as a beverage bottle storage cabinet.

13. A household appliance, comprising:

a body containing a beverage bottle receiving space;

an upper wall delimiting said beverage bottle receiving space, said illuminating device having a light module;

said upper wall being formed with at least one light transmission opening configured to enable light of said light module of said illuminating device to be radiated into said beverage bottle receiving space;

a distance adapter adjoining said light transmission opening, said distance adapter carrying said light module outside said beverage bottle receiving space and spacing said light module from an underside of said upper wall delimiting the beverage bottle receiving space, said distance adapter enabling light from said light module to be directed to said light transmission opening;

wherein said distance adapter has a bottom facing away from said beverage bottle receiving space, said bottom being formed with a continuous hole that is delimited by a circumferential abutment flange on which said light module is disposed;

wherein said distance adaptor has a front flange facing said upper wall; and wherein said distance adapter is arranged such that viewed in a depth direction of the household appliance an intersecting line of a plane of said abutment flange and a plane of said front flange is closer to a front edge of said wall than free edges of said planes.

14. A household appliance, comprising:

a body containing a beverage bottle receiving space;

an upper wall delimiting said beverage bottle receiving space;

an illuminating device for illuminating said beverage bottle receiving space, said illuminating device having a light module;

said upper wall being formed with at least one light transmission opening configured to enable light of said light module of said illuminating device to be radiated into said beverage bottle receiving space;

a distance adapter adjoining said light transmission opening, said distance adapter carrying said light module outside said beverage bottle receiving space and spacing said light module from an underside of said upper wall delimiting the beverage bottle receiving space, said distance adapter enabling light from said light module to be directed to said light transmission opening; and wherein said upper wall is a shelf that separates said beverage bottle receiving space from a further receiving space formed above said beverage bottle receiving space.

* * * * *